US008998440B1

(12) United States Patent
Wu et al.

(10) Patent No.: US 8,998,440 B1
(45) Date of Patent: Apr. 7, 2015

(54) ROTATING SIGNAGE LIGHT

(71) Applicants: Colin Wu, Guangdong (CN); Westly Davis Hetrick, Atlanta, GA (US); Rimet Zhang, Shanghai (CN)

(72) Inventors: Colin Wu, Guangdong (CN); Westly Davis Hetrick, Atlanta, GA (US); Rimet Zhang, Shanghai (CN)

(73) Assignee: Cooper Technologies Company, Houston, TX (US)

( * ) Notice: Subject to any disclaimer, the term of this patent is extended or adjusted under 35 U.S.C. 154(b) by 141 days.

(21) Appl. No.: 13/866,890

(22) Filed: Apr. 19, 2013

(51) Int. Cl.
*F21V 21/00* (2006.01)
*F21V 21/30* (2006.01)

(52) U.S. Cl.
CPC ..... *F21V 21/30* (2013.01)

(58) Field of Classification Search
USPC ..... 362/812, 217.1, 217.12, 249.01, 249.1, 362/285, 427
See application file for complete search history.

(56) References Cited

U.S. PATENT DOCUMENTS 5,416,679 A * 5/1995 Ruskouski et al. ..... 362/240
5,459,955 A * 10/1995 Ruskouski et al. ..... 40/570
D445,138 S 7/2001 Stark et al.
6,457,270 B1 10/2002 Stark et al.
7,774,965 B2 8/2010 Lee

* cited by examiner

*Primary Examiner* — Vip Patel
(74) *Attorney, Agent, or Firm* — King & Spalding LLP

(57) ABSTRACT

The present disclosure provides a rotating signage light fixture which can be mounted on a horizontal surface, such as a ceiling, or on a vertical surface, such as a wall. The rotating signage light fixture includes a housing portion and a sign portion, in which the sign portion is rotatable with respect to the housing portion. The housing portion includes a mounting surface with which the light fixture is mounted. In a first position, the sign is substantially perpendicular to the mounting surface, and the light fixture is suitable for mounting to a ceiling. In a second position, the sign is rotated 90° from its position in the first position, and is substantially parallel to the mounting surface. The sign, a light source, and electrical components of the light fixture all move and rotate together when the sign is rotated.

19 Claims, 5 Drawing Sheets

ROTATING SIGNAGE LIGHT

TECHNICAL FIELD

The present disclosure relates generally to signage lighting, such as an exit sign, having a rotatable offset hinge. Specifically, the present disclosure relates to signage lights providing both wall mounting means as well as ceiling mounting means.

BACKGROUND

Signage lights are commonplace in many public and private spaces, such as hallways, movie theaters, hospitals, and the like. Signage lights often provide directional guidance to those not familiar with the layout of a particular space or building. Examples of common signage lights are exit signs, elevator signs, and signs showing the direction to a particular location. Signage lights are typically mounted in high places where they can be unobstructed and easily seen, such as on ceilings or walls. Traditionally, signage lights are provided as either ceiling mount styles or wall mount styles, and thus cannot be easily used interchangeably. Certain signage lights can be mounted through the use of a canopy. The canopy may be attached to either the top of a signage light, in which case the signage light may be mounted on a ceiling, or to the back of a signage light, in which case the signage light would be mounted to a wall. However, such a solution is labor intensive for the user and generally only commonly used with relatively lightweight and simple signage lights. Recent advances in light emitting diode (LED) technology has motivated the use of LED edge lit signage lights, in which a row of LEDs illuminate a transparent or semi-transparent sign from an edge of the sign. Edge lit signage lights are relatively heavy and include relatively complex electrical circuits and components within the light fixture. Thus, previous solutions are unfit for the challenges presented by edge lit signage lights.

SUMMARY

In an example embodiment of the present disclosure, a rotatable signage light fixture includes a housing and an internal assembly rotatively coupled to the housing. The internal assembly includes an internal body, a printed circuit board (PCB) disposed on the internal body, at least one light source disposed on the internal body and electrically coupled to the PCB, and a sign at least partially retained by and extending from the internal body. The internal body, the PCB, the at least one light source, and the sign move together and are fixed in relation to each other when the internal assembly rotates with respect to the housing.

In another example embodiment of the present disclosure, a rotatable light fixture includes a main housing and an internal housing rotatively coupled to the main housing. The main housing includes a mounting surface and a retaining surface opposite the mounting surface. The retaining surface includes a gap and a first pivot mate. The internal housing includes a printed circuit board (PCB) disposed at least partially within the internal housing, a light source disposed at least partially within the internal housing, a second pivot mate, wherein the second pivot mate is rotatively coupled to the first pivot mate, and a retaining slot formed at an edge of the internal housing opposite the light source. The internal housing is rotatable between a first position and a second position with respect to the main housing via the first pivot mate and second pivot mate. The internal housing is at least partially within the main housing in the first position, and at least partially outside of the main housing in the second position. The internal housing, the PCB, and the light source move together and are fixed in relation to each other.

In another example embodiment of the present disclosure, a rotatable signage light fixture includes a housing. The housing includes a first pivot mate disposed within the housing. The housing further includes an internal assembly disposed at least partially within the housing. The internal assembly includes an internal housing, a printed circuit board (PCB), at least one light source, a second pivot mate rotatively coupled to the first pivot mate, and a retention slot opposite the at least one light source. The internal assembly is rotatable relative to the housing between a first position and a second position, wherein in the first position, the internal assembly is largely inside of the housing, and wherein in the second position, the internal assembly is largely outside of the housing. The housing further includes a retaining surface forming an opening through which the internal assembly rotates from being largely inside the housing to being largely outside of the housing. The rotatable signage light fixture further includes a sign comprising a top portion, wherein the top portion is coupled to the internal assembly.

BRIEF DESCRIPTION OF THE DRAWINGS

For a more complete understanding of the disclosure and the advantages thereof, reference is now made to the following description, in conjunction with the accompanying figures briefly described as follows.

Figure 1:
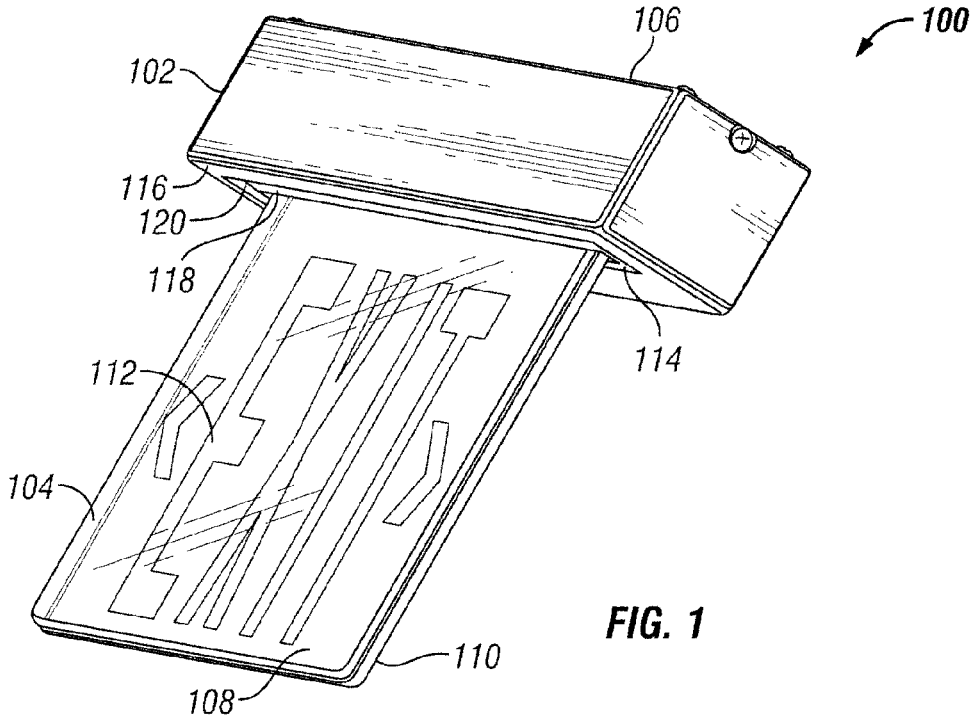
FIG. 1 illustrates a perspective view of a rotatable signage light fixture in an extended position, in accordance with an example embodiment of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of example with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure provides a rotatable signage light which is readily mountable on a ceiling or on a wall with minimal adjustments or modifications. FIG. 1 illustrates a rotatable signage light 100 in an extended position, in accordance with an example embodiment of the present disclosure. In the extended position, the rotatable signage light 100 is generally mounted on a ceiling, a ceiling beam, or other appropriate horizontal surface. The rotatable signage light 100 includes a main housing 102 and a sign 104. In certain example embodiments, and as illustrated, the main housing 102 is rectangularly shaped and includes a mounting surface 106 and a retaining surface 114 opposite the mounting surface 106. In certain example embodiments, the mounting surface 106 is mounted against a ceiling or wall surface with the mounting surface 106 facing the surface. The retaining surface 114 includes a retaining slot 116 which extends across a majority or entirety of the length of the retaining surface 114. The main housing 102 further houses an internal housing 120. The internal housing 120 houses electrical components as well as retains the sign 104. In the extended position, the internal housing 120 is generally positioned within the main housing 120. Thus, the body 202 of the internal housing 120 is hidden from view in FIG. 1. The sign 104 includes a top edge 118 which is disposed within and held by the internal housing 120. In certain example embodiments, the sign 104 includes a first panel 108 and a second panel 110. In certain example embodiments, the first and second panels 108, 110 are fabricated from an acrylic material and are shaped generally symmetrical to each other, and are symmetrically mated. In certain example embodiments, the first panel 108, the second panel 110, or both, includes a graphic 112 printed on the inner surface. The graphic 112 may include words, images, or any other form of signage. In another example embodiment, the graphic 112 may be an insert disposed between the first and second panels 108, 112. In certain example embodiments, the sign 104 is held stationary with respect to the internal housing 120, and the internal housing 120 and sign 104 together are rotatable relative to the main housing 102. In an example embodiment, the sign 104 and internal housing 120 are rotatable up to approximately 90° relative to the main housing 102. In the extended position, the sign 104 is substantially perpendicular to the mounting surface 106

Figure 2:
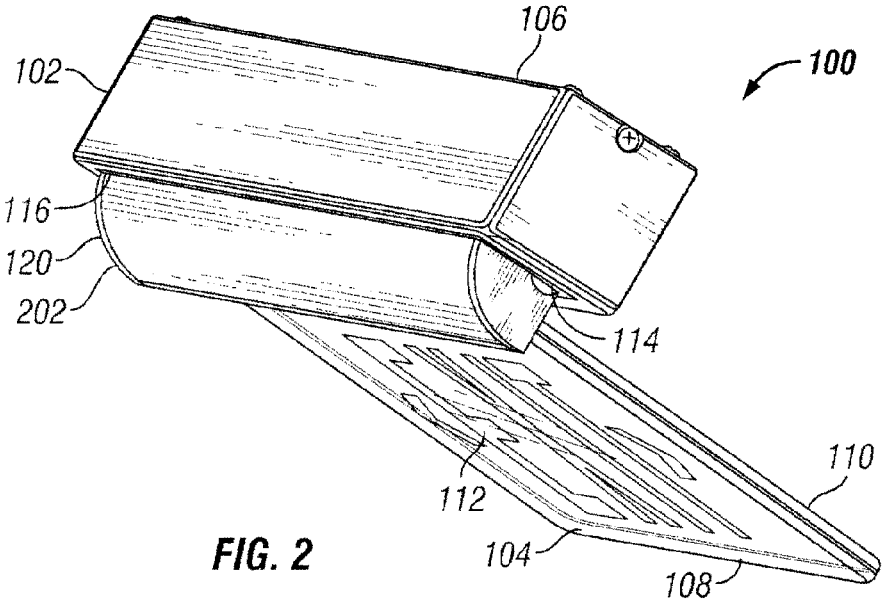
FIG. 2 illustrates a perspective view of the rotatable signage light fixture of FIG. 1 in a rotated position, in accordance with an example embodiment of the present disclosure.

FIG. 2 illustrates the rotatable signage light 100 in a rotated position, in accordance with an example embodiment. In the rotated position, the rotatable signage light 100 is generally mounted on a wall or other appropriate vertical surface via the same mounting surface 106 as in the extended position. In the rotated position, the sign 104 and internal housing 120 have been rotated approximated 90° relative to its position in the extended position, as shown in FIG. 1. Thus, in the rotated position, the sign 104 is substantially parallel to the mounting surface 106. In the rotated position, the internal housing 120 is rotated to a position at least partially external to the main housing 102. Thus, the body 202 of the internal housing 120 is visible in FIG. 2.

Figure 3:
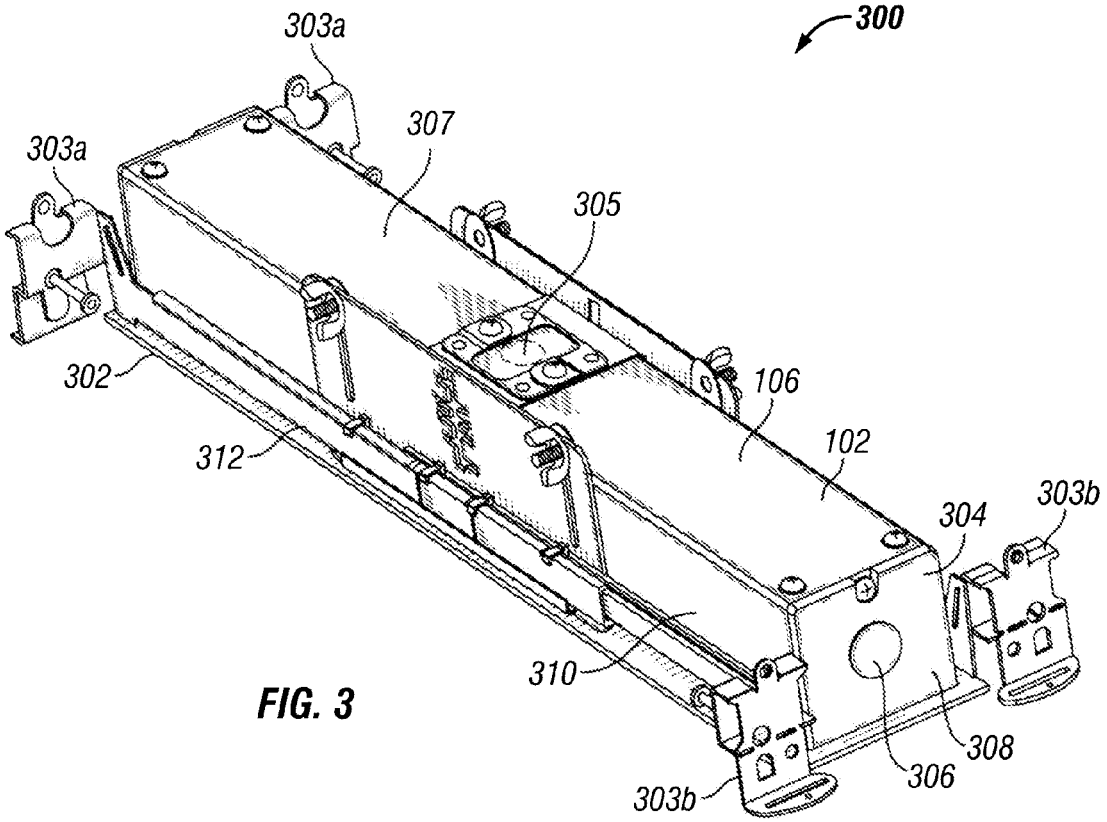
FIG. 3 illustrates a perspective view of a main housing assembly of a rotatable signage light fixture, in accordance with an example embodiment of the present disclosure.

FIG. 3 illustrates a housing assembly 300 for use with the rotatable signage light 100 illustrated in FIG. 1, in accordance with example embodiments. The housing assembly 300 includes the main housing 102, and in certain example embodiments, also includes one or more hanger bars 302. The main housing 102 includes the mounting surface 106, the retaining surface 114 (FIG. 1), a first end surface 304, a second end surface (not shown) opposite the first end surface 304, a first side surface 310, and a second side surface (not shown) opposite the first side surface 310. In certain example embodiments, the mounting surface 106 includes an opening 305 formed therein. In certain example embodiments, a top plate 307 having similar dimensions as the mounting surface 106 is removably disposed on the mounting surface 106. Thus, when the top plate 307 is removed, the opening 305 in the mounting surface 106 is exposed. When the top plate 307 is disposed on the mounting surface, the opening 305 is covered and hidden. When the main housing 102 is mounted on a wall or ceiling via the mounting surface 106, the top plate 307 is removed. Thus, electrical building wires can be electrically coupled to the rotatable signage light 100 through the opening 305 in the mounting surface 102, thereby electrically coupling the rotatable signage light 100 to a wall junction box, conductor, or power source. In certain example embodiments, the first end surface 304 similarly includes an opening 306 formed therein. In certain example embodiments, an end plate 308 is removably disposed on the first end surface 304, covering up the opening 306 when disposed on the first end surface 304 and revealing the opening 306 when removed from the first end surface 304. In certain example embodiments, the second end surface (not shown) is configured similarly. In certain example embodiments, the main housing 102, and the rotatable signage light 100 can be mounted on a wall or other vertical surface via the first end surface 306 or second end surface (not shown). In such a mounting configuration, the end plate 308 is generally removed and electrical building wires are electrically coupled to the rotatable signage light 100 via the opening 306, thereby electrically coupling the rotatable signage light 100 to a wall junction box, conductor, or power source. In certain example embodiments, the rotatable signage light 100 is powered by electrical building wire. In certain example embodiments, the rotatable signage light 100 also includes a power storage device, such as a battery, which is configured to provide power to the rotatable signage light 100 during certain events, such as a power outage event, in which the building power lines fail to provide power to the rotatable signage light 100. In certain example embodiments, the power storage devices is charged with power from the power lines during normal operation conditions.

In certain exemplary embodiment, the rotatable signage light is mountable within a ceiling or wall such that the main housing 102 is partially or completely embedded within the ceiling or wall. In such an embodiment, the hanger bars 302 are secured to the first side surface 310 and second side surface (not shown). The hanger bars 302 each include a first mounting end 303*a* and a second mounting end 303*b*. The main housing 102 is thus mountable between two beams, studs, or the like via the first and second mounting ends 303*a*, 303*b*. In certain example embodiments, the hanger bar 302 include an extendable rail 312, which provides a variable distance between the first mounting end 303*a* and the second mounting end 303*b*. Thus, the main housing 102 is mountable between beams placed apart at various distances. In certain example embodiments, the hanger bars 302 are removed from the main housing 102 when the main housing 102 is mounted on the surface of a wall or ceiling rather than within the wall or ceiling.

Figure 4:
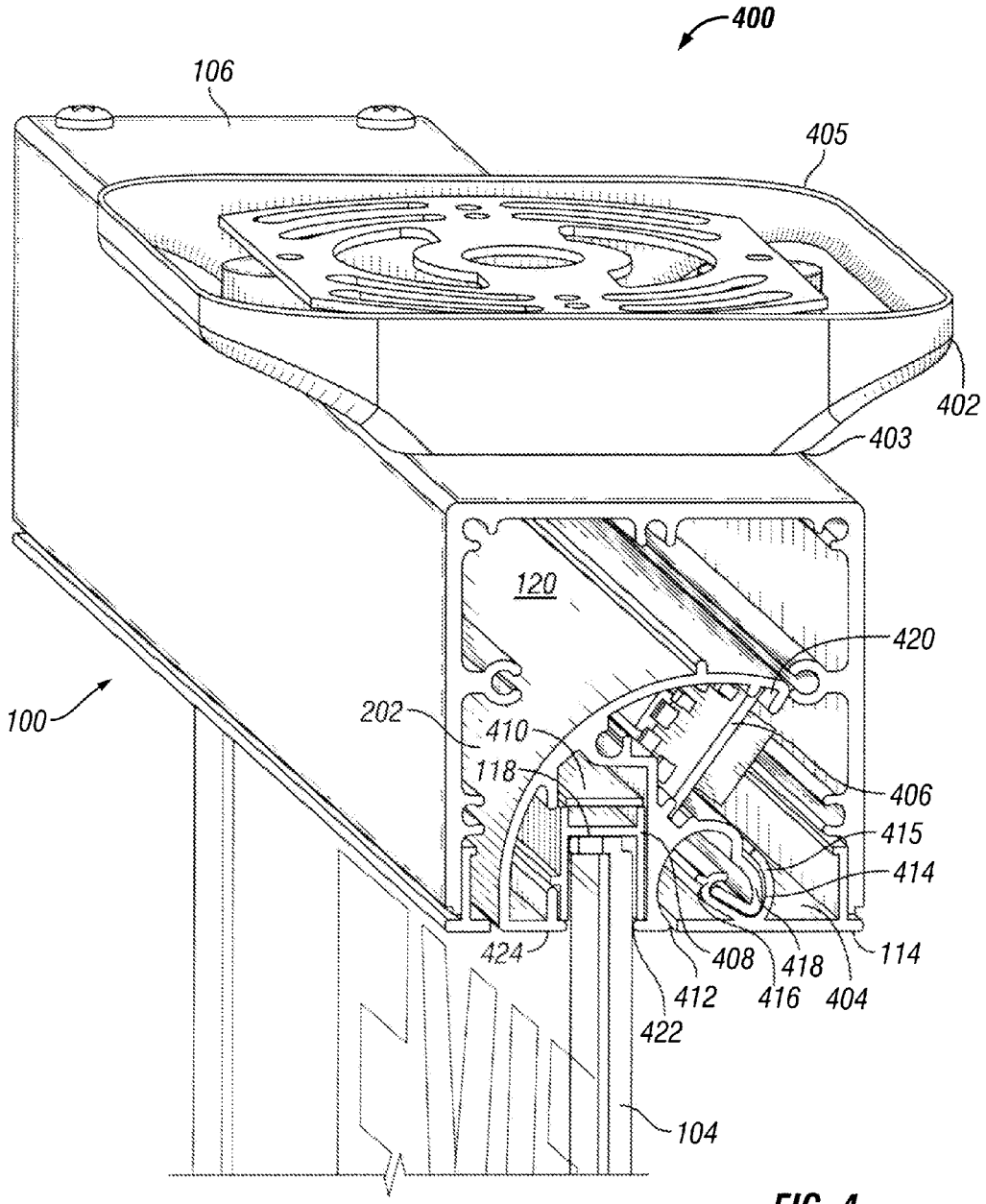
FIG. 4 illustrates a cross-sectional view of the rotatable signage light fixture of FIG. 1, in accordance with an example embodiment of the present disclosure.
Figure 5:
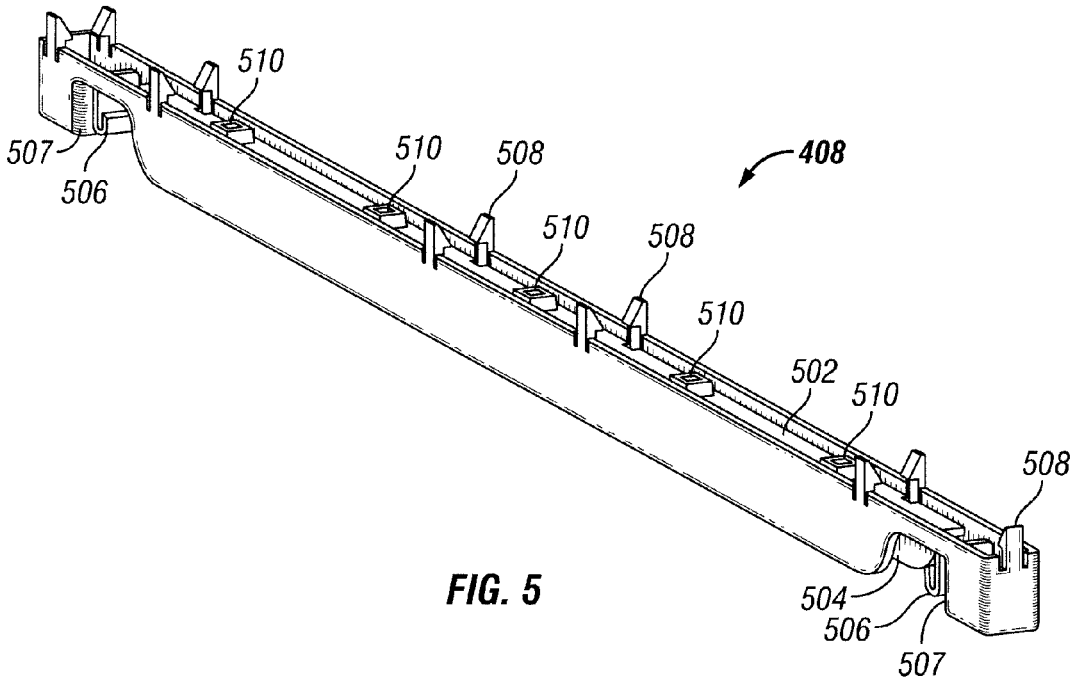
FIG. 5 illustrates a perspective view of a retention bar of the rotatable signage light fixture of FIG. 4, in accordance with an example embodiment of the present disclosure.

FIG. 4 illustrates a cross-sectional view 400 of the rotatable signage light 100 in accordance with an example embodiment. Also illustrated in FIG. 4 is a canopy 402. In certain example embodiments, the canopy is removably attached to the mounting surface 106 on a first side 403 and mountable to a wall or ceiling on a second side 405. Thus, in such embodiments, the rotatable signage light 100 is mounted on a ceiling or wall via the canopy 402. In certain example embodiments, such as when the main housing 102 is mounted within a ceiling or wall, or when the main housing 102 is mounted to a wall via the first side surface 304, the canopy may be removed. As previously discussed, the main housing 102 includes a retaining surface 114 through which the sign 104 is coupled to the internal housing 120. Specifically, the retaining surface 114 includes a slot 412 through which the internal housing 120 rotates and through which the sign 104 extends. The internal housing 120 further includes a curved body 202 which remains retracted within the main housing 102 when the rotatable signage light 100 is in the extended position, as shown in FIG. 1, and is exposed when the rotatable signage light 100 is in the rotated position, as shown in FIG. 2. In certain example embodiments, the internal housing 120 further includes a recess 422 which extends from within the internal housing 120 to an edge 424 of the internal housing 120. The edge 424 is generally flush and aligned with the retaining surface 114 of the main housing 102 when the rotatable signage light is in the extended position. In certain example embodiments, an LED and sign retention bar 408 is disposed through the recess 422 and extends through the majority or entirety of the length of the main housing 102. The LED and sign retention bar 408 is further illustrated in detail in FIG. 5, in accordance with an example embodiment. Referring to FIGS. 4 and 5, the retention bar 408 includes a top portion 502 and a bottom portion 504. In certain example embodiments, a light source circuit board 410 is disposed along the top portion 502 and held in place by one or more clipping mechanisms 508. The light source circuit board 410 includes one or more light sources, such as LEDs (not shown). The light sources are electrically coupled to the light source circuit board 410 and are directed downward towards the bottom portion 504 of the retention bar 408. The bottom portion 504 includes a slot in which the top edge 118 of the sign 104 is disposed and held. Thus, the light sources are directed towards the sign 104 and configured to provide illumination of the sign 104. In certain example embodiments, the retention bar 408 includes one or more openings 510 connecting the top portion 502 and the bottom portion 504, through which light from the light sources travels to illuminate the sign 104 held in the bottom portion 504. The openings 510 are typically positioned correspondingly to the positions of the light sources on the light source circuit board 410. The bottom portion 506 of the retention bar 410 includes one or more retention hooks 506 for securing the top edge 118 of the sign within the retention bar 408. In certain example embodiments, the retention hooks 506 are disposed at ends 507 of the retention bar 408 and receive corresponding mating features (not shown) at corresponding positions on the sign 104, thereby retaining the sign 104.

Figure 6:
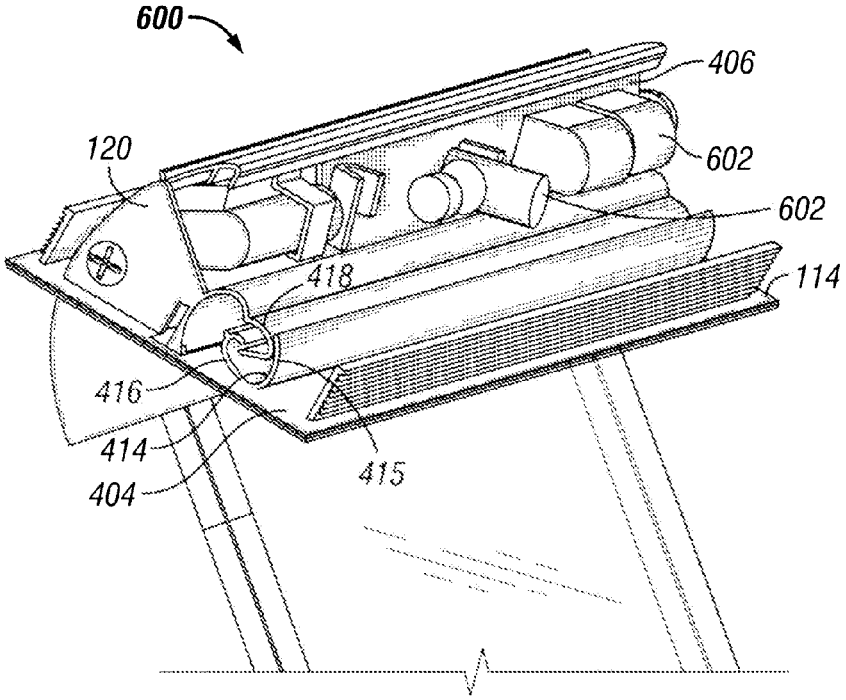
FIG. 6 illustrates a perspective view of an internal assembly of the rotatable signage light fixture of FIG. 4, in accordance with an example embodiment of the present disclosure.

FIG. 6 illustrates a perspective view of an internal assembly 600, which includes the internal housing 120, retaining surface 114, and sign 104, and in which the main housing 102 removed, in accordance with an example embodiment. Referring to FIGS. 4 and 6, the internal housing 120 includes a PCB slot 420, in which a printed circuit board (PCB) 406 is disposed. The PCB 406 holds and electrically couples electronic components 602 which drive the light sources. In certain example embodiments, the electronic components include a power storage device, such as a battery, which provides power to the light sources under certain conditions, such as a power outage event. Accordingly, the PCB 406 is also electrically coupled to the light source PCB 410. In certain example embodiments, the PCB 406, the light source PCB 410, and the sign 104 all are secured at least partially within and relative to the internal housing 120. Thus, when the internal housing 120 is rotated to put the sign 104 into either the extended position (FIG. 1) or the rotated position (FIG. 2), the internal housing 120, the sign 104, the PCB 406, and the light source PCB 410 all move together, such that there is generally no relative movement between the internal housing 120, the sign 104, the PCB 406, and the light source PCB 410. Such a configuration provides at least the advantage of reduced wear on the electrical connections between the PCB 406 and the light source PCB 410.

As illustrated in FIGS. 4 and 6, the retaining surface 114 includes a first pivot mate 414 coupled to an internal surface 404. In certain example embodiments, the first pivot mate 414 includes a curved portion 415 and a hook portion 416. Correspondingly, in certain example embodiments, the internal housing 120 includes a second pivot mate 418 fitted within the first pivot mate 414. The interaction between the first pivot mate 414 and the second pivot mate 418 provides pivoting means which allow the internal housing 120 and sign 104 to rotate between the extended position (FIG. 1) and the rotated position (FIG. 2). As illustrated in FIG. 6, the first pivot mate 414 and the second pivot mate 418 are linear structures which extend along a portion or entirety of the length of the internal housing 120 and retaining surface 114.

Figure 7:
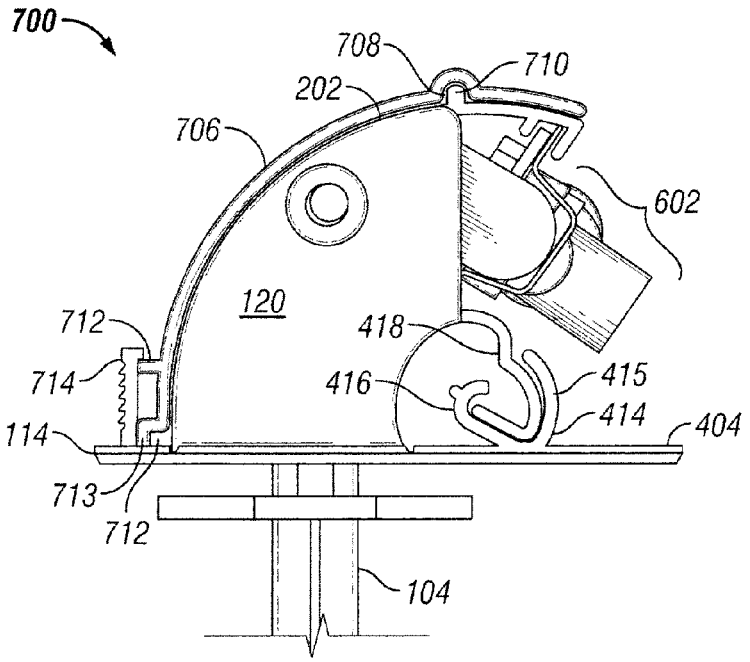
FIG. 7 illustrates a side view of the internal component assembly of FIG. 6 in an extended position, in accordance with an example embodiment of the present disclosure.
Figure 8:
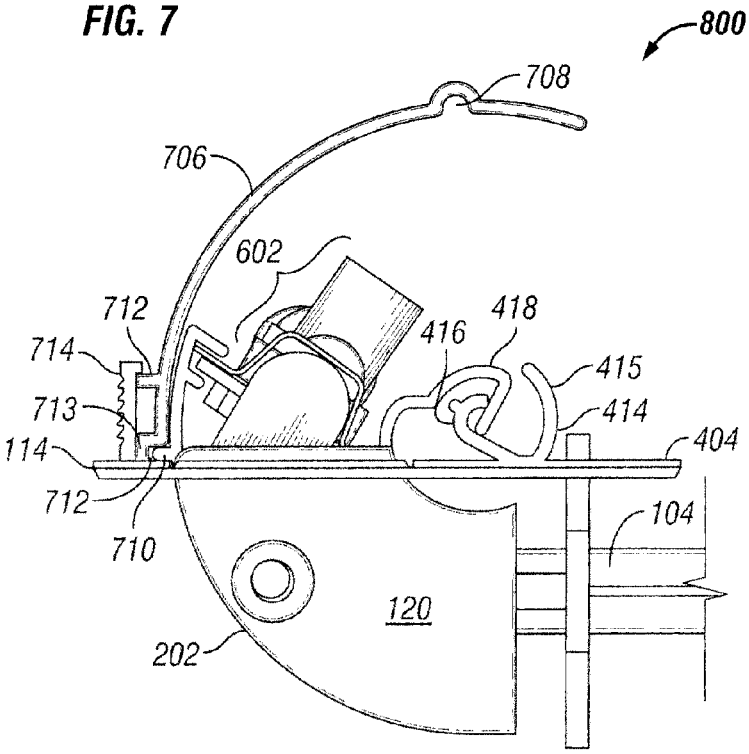
FIG. 8 illustrates a side view of the internal component assembly of FIG. 6 in a rotated position, in accordance with an example embodiment of the present disclosure.

FIG. 7 provides a detailed side view of an extended internal assembly 700, illustrating the first pivot mate 414 and the second pivot mate 418 when the sign 104 is in an extended position, in accordance with an example embodiment. In the extended position, the second pivot mate 418 is disposed largely within the first pivot mate 414, as shown. FIG. 8 provides a detailed side view of a rotated internal assembly 800, illustrating the first pivot mate 414 and the second pivot mate 418 when the sign 104 is in a rotated position, in accordance with an example embodiment. In the rotated position, the second pivot mate 418 is rotated to be largely outside of the first pivot mate 414. However, a portion of the second pivot mate 418 remains intact with the first pivot mate 414. Specifically, during the rotation of the sign 104 second pivot mate 418, the second pivot mate 418 moves outwardly relative to the first pivot mate 414, in which the angle of movement (rotation) is guided by the curved portion 415 of the first pivot mate 414 and the second pivot mate 418 is retained relative to the first pivot mate 414 by the hook portion 416 of the first pivot mate 414. In certain example embodiments, the second pivot mate 418 is rotatable while the first pivot mate 414 remain stationary relative to the main housing 102. As illustrated in FIGS. 7 and 8, as the internal housing 120 rotates from the extended position (FIG. 7) to the rotated position (FIG. 8), the sign 104, the internal housing 120, the electronic components 602, and light sources all move and rotate fixedly with respect to each other. In certain example embodiments, the sign 104, the internal housing 120, the electronic components 602, and the light sources do not traverse the axis of rotation or pivot point and there is no rotation between such elements. The figures and above description provide an example embodiment of a pivoting mechanism. In certain example embodiments, the internal housing 120 is made rotatable relative to the retaining surface 114 and main housing 102 by a pivoting mechanism other than that shown in the figures and detailed above, as would be known to one of ordinary skill in the art.

In certain example embodiments, the internal assembly 700, 800 includes a positioning clip 706. The positioning clip 706 stabilizes and/or secures the internal housing 120 relative to the main housing 102 when the internal housing 120 is placed in either the extended position or the rotated position. In certain example embodiments, the positioning clip 706 includes a curved shape corresponding to the curved body 202 of the internal housing 120. The positioning clip 706 further includes a first notch 708 and a second notch 712. The first notch 708 is positioned approximately 90° from the second notch 712. The body 202 of the internal housing 120 includes a protrusion 710 which is configured to fit within either notch 708, 712. Specifically, referring to FIG. 7, when the internal housing 120 is in the extended position, the protrusion 710 in the internal housing 120 is held within the first notch 708 of the positioning clip 706, thereby stabilizing the internal housing 120 in the extended position. Referring to FIG. 8, when the internal housing 120 is in the rotated position, the protrusion 710 is rotated approximately 90° and thus, is retained within the second notch 714. The internal housing 120 is thereby stabilized in the rotated position. In certain example embodiments, the positioning clip 706 is removed from the internal housing 120 while the internal housing 120 is being rotated from the extended position to the rotated position or from the rotated position or the extended position. Furthermore, the positioning clip 706 includes an exterior protrusion 712 and an end piece 713 at fixed positions on the positioning clip 706. The interior surface 404 of the retaining surface 114 includes a ledged extension which holds the position of the positioning clip 706 stationary relative to the retaining surface 114 and main housing 102. As the internal housing 120 is held stationary relative to the positioning clip 706 when it is in a desired position, the internal housing 120 is thus held stationary relative to the main housing 102. The illustrated and described positioning clip 706 is one specific example of a stabilization mechanism that can be used to stabilize the internal housing 120 in a position. In certain other example embodiments, the stabilization mechanism includes different elements, and/or which do not need to be removed during position transitions.

Although embodiments of the present disclosure have been described herein in detail, the descriptions are by way of example. The features of the disclosure described herein are representative and, in alternative embodiments, certain features and elements may be added or omitted. Additionally, modifications to aspects of the embodiments described herein may be made by those skilled in the art without departing from the spirit and scope of the present disclosure defined in the following claims, the scope of which are to be accorded the broadest interpretation so as to encompass modifications and equivalent structures.

What is claimed is:

1. A rotatable light fixture, comprising:

a main housing, wherein the main housing comprises a mounting surface and a retaining surface opposite the mounting surface, wherein the retaining surface includes a first pivot mate; and an internal housing rotatively coupled to the main housing, the internal housing comprising:

a printed circuit board (PCB) disposed at least partially within the internal housing;

a light source disposed at least partially within the internal housing;

a second pivot mate, wherein the second pivot mate is rotatively coupled to the first pivot mate; and a retaining slot formed at an edge of the internal housing opposite the light source;

wherein the internal housing is rotatable between a first position and a second position with respect to the main housing via the first pivot mate and second pivot mate;

wherein the internal housing is at least partially within the main housing in the first position, and at least partially outside of the main housing in the second position, and wherein the internal housing, the PCB, and the light source move together and are fixed in relation to each other.

2. The rotatable light fixture of claim 1, further comprising:

a sign comprising a top portion, wherein the top portion is disposed within and retained by the retaining slot.

3. The rotatable light fixture of claim 2, wherein when the internal housing rotates with respect to the main housing, the sign, the internal housing, the PCB, and the light source move together and remain fixed in relation to each other.

4. The rotatable light fixture of claim 2, wherein in the first position, the sign is approximately perpendicular to the mounting surface, and in the second position, the sign is approximately parallel to the mounting surface.

5. The rotatable light fixture of claim 2, wherein the light source is directed towards the sign.

6. The rotatable light fixture of claim 1, wherein the PCB provides power to and drives the light source.

7. The rotatable light fixture of claim 1, further comprising:

a battery coupled to the PCB, wherein the battery provides power to the light source during a power outage event.

8. The rotatable light fixture of claim 4, wherein the main housing is mountable on a substantially horizontal surface in the first position and mountable on a substantially vertical surface in the second position.

9. A rotatable signage light fixture, comprising:

a housing comprising:

a first pivot mate disposed within the housing;

an internal assembly disposed at least partially within the housing, the internal assembly comprising an internal housing, at least one light source, a second pivot mate rotatively coupled to the first pivot mate, and a retention slot opposite the at least one light source, wherein the internal assembly is rotatable relative to the housing between a first position and a second position, wherein in the first position, the internal assembly is largely inside of the housing, and wherein in the second position, the internal assembly is largely outside of the housing;

a printed circuit board (PCB) disposed within the housing and electrically coupled to the at least one light source;

a retaining surface forming an opening through which the internal assembly rotates from being largely inside the housing to being largely outside of the housing, and a sign comprising a top portion, wherein the top portion is coupled to the internal assembly.

10. The rotatable signage light fixture of claim 9, wherein the internal housing, the printed circuit board, the sign, and the at least one light source move together and are fixed relative to each other when the internal assembly is rotated.

11. The rotatable signage light fixture of claim 9, wherein the degree of rotation of the internal assembly between the first position and the second position is approximately 90°.

12. The rotatable signage light fixture of claim 9, wherein the housing comprises a mounting surface opposite the retaining surface, the mounting surface mountable on a horizontal mounting structure or a vertical mounting structure.

13. The rotatable signage light fixture of claim 12, wherein in the first position, the sign is approximately perpendicular to the mounting surface, and wherein in the second position, the sign is approximately parallel to the mounting surface.

14. The rotatable signage light fixture of claim 9, wherein the at least one light source is directed towards a top edge of the sign.

15. The rotatable signage light fixture of claim 12, wherein the housing further comprises:

a first side surface perpendicular and coupled to the mounting surface;

a second side surface opposite the first side surface and perpendicular and coupled to the mounting surface;

a first mounting mechanism coupled to the first side surface; and a second mounting mechanism coupled to the second side surface, wherein the housing is mountable to a wall or between two beams via the first mounting mechanism, the second mounting mechanism, or both.

16. A rotatable signage light fixture, comprising:

a housing;

an internal assembly rotatively coupled to the housing, the internal assembly comprising:

an internal body;

a printed circuit board (PCB) disposed on the internal body;

at least one light source disposed on the internal body and electrically coupled to the PCB; and a sign at least partially retained by and extending from the internal body;

wherein the internal body, the PCB, the at least one light source, and the sign move together and are fixed in relation to each other when the internal assembly rotates with respect to the housing.

17. The rotatable signage light fixture of claim 16, wherein the housing comprises a mounting surface, wherein the internal assembly is rotatable between a first position and a second position, wherein in the first position, the sign is substantially perpendicular to the mounting surface, and wherein in the second position, the sign is substantially parallel to the mounting surface.

18. The rotatable signage light fixture of claim 16, wherein the housing comprises a first pivot mate and the internal assembly comprises a second pivot mate rotatively coupled to the first pivot mate.

19. The rotatable signage light fixture of claim 16, wherein the at least one light source comprises at least one light emitting diode (LED).

* * * * *